United States Patent [19]

Naya et al.

[11] Patent Number: 4,971,866

[45] Date of Patent: Nov. 20, 1990

[54] VACUUM SWITCH CONTACT MATERIALS AND THE MANUFACTURING METHODS

[75] Inventors: Eizo Naya; Mitsuhiro Okumura, both of Amagasaki, Japan

[73] Assignee: Mitsubishi Denki Kabushiki Kaisha, Tokyo, Japan

[21] Appl. No.: 462,022

[22] Filed: Jan. 8, 1990

[30] Foreign Application Priority Data

Jan. 25, 1989 [JP] Japan ..... 1-15943

[51] Int. Cl.[5] ..... H01H 33/66; C22C 32/00

[52] U.S. Cl. ..... 428/614; 75/232

[58] Field of Search ..... 428/614; 75/232

[56] References Cited

FOREIGN PATENT DOCUMENTS 59-215621 12/1984 Japan .

60-181269 9/1985 Japan ..

61-131319 6/1986 Japan .

*Primary Examiner*—Theodore Morris

*Assistant Examiner*—David W. Schumaker

*Attorney, Agent, or Firm*—Birch, Stewart, Kolasch & Birch

[57] ABSTRACT

In manufacturing contact materials which satisfy all the criteria required for use in vacuum switches as to chopping current, circuit breaking performance, withstanding voltage, welding separation force and wear, Cu powder and $Ta_2O_5$ powder are mixed, and compressed while heating below the melting point of Cu in a nonoxidizing atmosphere. Alternatively a green compact is first manufactured from $Ta_2O_5$ powder or a mixture of $Ta_2O_5$ and Cu powder, and molten Cu is made to infiltrate into the compact. Preparing a green compact from a mixture of Cu powder and $Ta_2O_5$ powder, it may be sintered at a temperature below the melting point of Cu, re-pressed, and resintered at 400°-900° C. in a nonoxidizing atmosphere.

7 Claims, 6 Drawing Sheets

VACUUM SWITCH CONTACT MATERIALS AND THE MANUFACTURING METHODS

BACKGROUND OF THE INVENTION

This invention relates to a contact material for a vacuum switch, to a method of manufacture.

The characteristics required of a vacuum switch contact material include superior circuit breaking performance, high withstanding voltage, a small chopping current, low welding separation force (which means a force required for pulling apart both contacts melted together by means of current) and low wear. A material which satisfies all of these characteristics has however, still not been developed, and some of these characteristics have to be sacrificed depending on the intended application under the present conditions.

Cu—Cr contact materials, for example, have excellent circuit breaking performance and withstand voltage, and so they are used mainly for vacuum circuit breakers, however as they have a high chopping current, they are not very suitable for motor switches. Also, they have a rather high welding separation force, so that considerable force has to be exerted on the circuit breaker side. Ag—WC contact materials, on the other hand, have a small chopping current and are therefore used in vacuum switches for motors, but they have inferior circuit breaking performance and are not very suitable as circuit breakers.

The characteristics of contacts therefore depend on the materials of which they consist, but their characteristics may also vary according to the method of the their manufacture. For example, Cu—Cr contact materials manufactured by the sintering method show peak circuit breaking performance when the Cr content is near 25% by weight, bu if manufactured by the infiltration method, they show peak performance when the Cr content is near 45% by weight.

Conventional vacuum switch contact materials, therefore, were not satisfactory with respect to all characteristics, and some characteristics had to be sacrificed in order to fit a specific application. A contact material was therefore desired which could offer some improvement in the above-described characteristics, even if only slight.

The inventors also discovered contact materials with excellent circuit breaking performance and anti-weld property, which consists of Cu (main component), a secondary component such as Mo, and metal oxides such as $Ta_2O_5$, and already filed a patent claim for them (Japanese Patent Application Laid-Open No. 1984-215621). Even these materials were however, unsatisfactory since as a stable, low chopping current could not be obtained. This was probably due to the effect of the secondary material, and some improvement was desired.

SUMMARY OF THE INVENTION

This invention was conceived to eliminate the above problems, to provide a contact material with a low chopping current, excellent circuit breaking performance and withstanding voltage, low welding separation force (which means a force required for pulling apart both contacts melted together by means of current) and low wear, and a method for manufacturing this material.

The object of this invention is to provide:

a vacuum switch contact material consisting essentially of Cu, and a tantalum oxide given by the formula $Ta_xO_y$, where $x=1-2$, and $y=1-5$;

a method of manufacturing a vacuum switch contact material, wherein Cu powder and $Ta_2O_5$ powder are mixed together, and the powder mixture obtained is compressed while being heated at a temperature below the melting point of Cu in a nonoxidizing atmosphere;

a method of manufacturing a vacuum switch contact material, wherein a green compact is first manufactured from $Ta_2O_5$ powder or a mixture of $Ta_2O_5$ and Cu powder, and by raising the pressure of the furnace atmosphere while depositing the compact in a molten Cu in a nonoxidizing atmosphere, molten Cu is made to infiltrate into the voids in the compact; and a method of manufacturing a vacuum switch contact material, wherein a green contact is first manufactured from a mixture of Cu powder and $Ta_2O_5$ powder, the compact is sintered at a temperature below the melting point of Cu in a nonoxidizing atmosphere, the sintered compact obtained is re-pressed, and the resintered at a temperature of 400°-900° C. in a nonoxidizing atmosphere.

As a result, the contact material of this invention has all the properties required of a vacuum switch, e.g. suitable circuit breaking performance, withstanding voltage, chopping current, welding separation force and wear, and a material with these excellent properties can moreover be manufactured by the method of this invention.

DETAILED DESCRIPTION OF THE EMBODIMENTS

Figure 1:
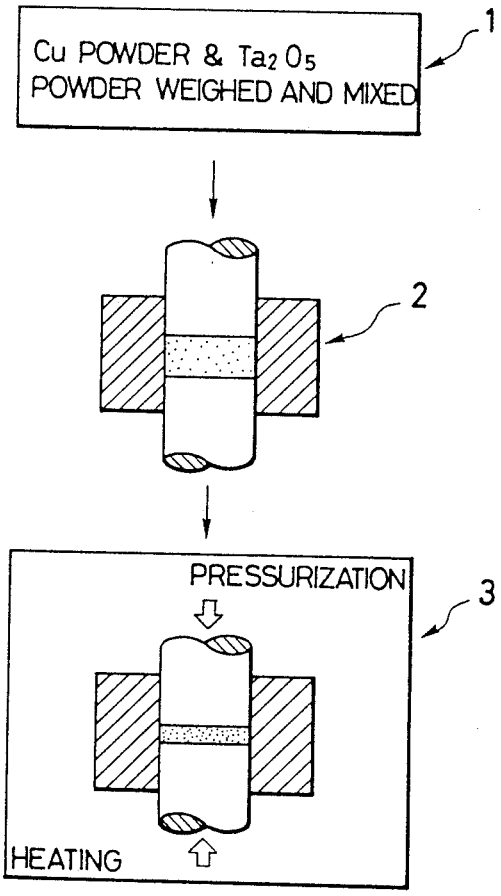
FIG. 1 is a flowchart showing the major steps in the manufacture of the contact material of Embodiment 1.

The contact material in this invention, which consists essentially of Cu and $Ta_xO_y$ (where $x=1-2$ and $y=1-5$), satisfies all the criteria required for use in vacuum switches as to chopping current, circuit breaking performance, withstanding voltage, welding separation force (which means a force required for pulling apart both contacts melted together be means of current) and wear.

X-ray diffraction analysis shows that apart from $Ta_2O_5$, compounds such as $TaO_2$ and $Ta_2O_3$ are also present as the above-mentioned $Ta_xO_y$.

The proportions of Cu and $Ta_xO_y$ in the contact material of this invention vary according to the manufacturing method. However, from the viewpoint of circuit-breaking performance the proportion by volume should be 98/2-25/75, from the view point of chopping current it should be 60/40-20/80, and from the viewpoint of withstand voltage it should be 95/5-20/80, specifically 60/40-25/75 is preferable.

When the contact material is manufactured by Method 1 to be described later, in order to give it improved circuit breaking performance compared to conventionl Cu—Cr contacts containing 25% Cr by weight, the proportion of $Cu/Ta_xO_y$ should be 98/2–45/55 (these proportions are represented by volume unless otherwise specified); to keep the chopping current below 1 A after the switch has operated 10,000 times on a load voltage of 600 A, the proportion should be 60/40–20/80; and to obtain a contact material which, while excelling in the above two points, has a welding separation force of not more than 10 kg f with low wear, the proportion should be 60/40–45/55.

Contact materials manufactures by Method 1 have excellent electrical performance such as high circuit breaking performance and a small chopping current, and they do not demand an excessive equipment outlay.

When the contact material is manufactured by Method 2 to be described later, in order to give it improved circuit breaking performance compared to conventional Cu—Cr contacts containing 25% parts by weight of Cr, the proportion $Cu/Ta_xO_y$ should be 65/35–25/75; to keep the chopping current below 1 A after the switch has operated 10,000 times on a load current of 600 A, the proportion should be 60/40–20/80; and to obtain a contact material which, while excelling in the above 2 points, has a welding separation force of not more than 10 kgf with low wear, the proportion should be 60/40–25/75.

Contact materials manufactured by Method 2 are excellent in that since they can be made to contain a high proportion of $Ta_2O_5$, the compositional proportion can be chosen so as to fully satisfy the requirements of high circuit breaking performance and a small chopping current.

When the contact material is manufactured by Method 3 to be described later, in order to give it improved circuit breaking performance compared to conventional Cu—Cr contacts containing 25% Cr by weight, the proportion of $Cu/Ta_xO_y$ should be 95/5–55/45; to keep the chopping current below 1 A after the switch has opened and closed 10,000 times on a load current of 600 A, the proportion should be 60/40–50/50; and to obtain a contact material which, while excelling in the above 2 points, has a welding separation force of not more than 10 kg f with low wear, the proportion should be 60/40–55/45.

Contact materials manufactured by Method 3 have slightly inferior performance compared to those manufactured by other methods, but the method has the excellent advantage that it requires no new equipment, and conventional equipment may be used by established manufacturers in the field.

Methods of manufacturing the contact material of this invention will now be described.

Since Cu and $Ta_2O_5$, the components of the contact material of this invention, have very poor mutual wettability, a satisfactory material cannot be obtained by conventional manufacturing methods. They can, however, be obtained by the three methods described below.

In Method 1, as shown in FIG. 1, Cu powder and $Ta_2O_5$ powder are first mixed together 1, the powder mixture obtained is packed into a carbon die or other device 2, and the mixture is compressed while heating it at a temperature below the melting point of Cu in a nonoxidizing atmosphere 3.

The above-mentioned Cu powder should preferably have a purity of not less than 99%, and a particle diameter no greater than 70 μm. It is also perferable that the $Ta_2O_5$ powder should have a purity of not less than 99%, and a particle diameter no greater than 40 μm. Instead of $Ta_2O_5$ powder, other tantalum oxide powders may be used, but as they are thermally unstable compared to $Ta_2O_5$ and are more difficult to procure, $Ta_2O_5$ is to be preferred.

$Cu/Ta_2O_5$, the mixing proportion of Cu powder and $Ta_2O_5$ powder is 99/1–20/80 by volume, but taking electrical properties into consideration, it is preferable that this proportion is 60/40–45/55. If the proportion of $Ta_2O_5$ powder exceeds 80% by volume, the pressure used in the pressurizing step described below has to be very high, and bigger and more costly equipment tends to be required.

The mixing of Cu powder and $Ta_2O_5$ may be carried out by the usual method.

The above-mentioned nonoxidizing atmosphere prevents oxidation of the Cu powder, and promotes the sintering process. It may be a reducing atmosphere such as hydrogen, an inert gas atmosphere such as argon or nitrogen, or a vacuum of about $10^{-3}$–$10^{-5}$ torr. Of these, hydrogen or a vacuum is to be preferred from the viewpoint that it reduces the surface of the Cu powder and promotes sintering.

The temperature used in the heating must be below the melting point of Cu (1083° C.) to prevent blow-out of molten Cu through the gaps in the carbon die, and it should preferably be no higher than 1080° C. If it is too low, however, an excessive pressure has to be used in the pressurizing step, and a very long time is required for the pressurization. In practice, therefore, a temperature of not less than 900° C. and preferably not less than 1050° is desirable.

There are no special restrictions on the method used to achieve the pressurization, however a load of not less than 200 kg/cm$^2$ is preferable from the viewpoint of reducing the the percentage of voids and promoting sintering. If the load is increased, the pressurization time can be shortened, but the pressurizing mechanism and die then have to be made larger. In practice, therefore, it is preferable to use a pressure no greater than 500 kg/cm$^2$. The time required for pressurization is from 30 min.–3 hours as it is preferable to achieve the density of a sintered compact of not less than 99%. The time should be regulated appropriately such that if $Ta_2O_5$ is present in large quantity as a constituent the time is lengthened, and if the pressurizing load is high the time is shortened. If however a density of 99% cannot be achieved even if 3 hours is exceeded, a very long time would be required unless the pressurizing load were increased, and this is impractical from a production viewpoint.

Figure 2:
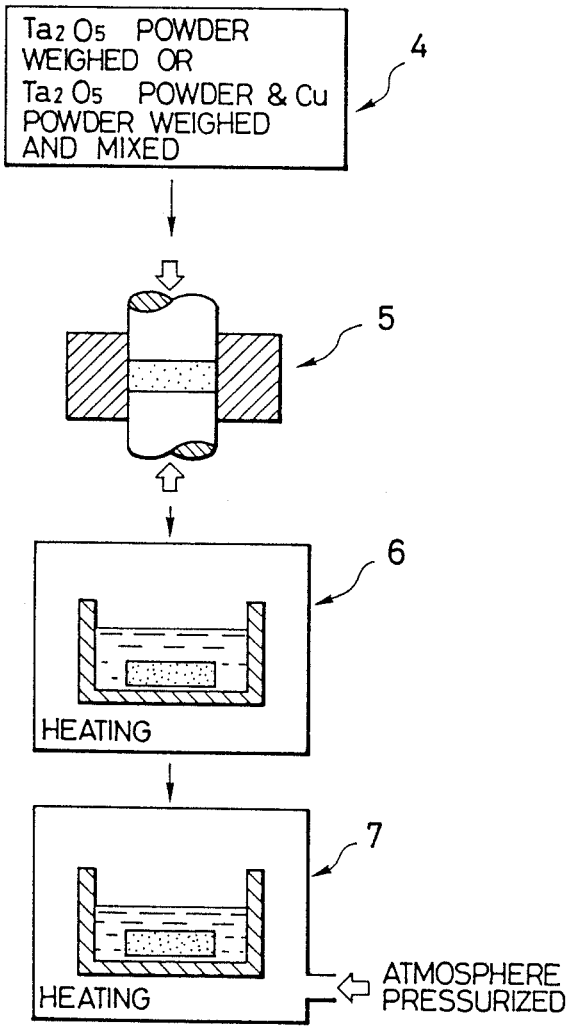
FIG. 2 is a flowchart showing the major steps in the manufacture of the contact material of Embodiment 2.

In method 2, as shown in FIG. 2, $Ta_2O_5$ powder is taken or $Ta_2O_5$ powder and Cu powder are mixed together 4, and used to make a green compact 5. While the compact is placed in a molten Cu 6, the pressure of the ambient nonoxidizing atmosphere is then increased such that the molten Cu infiltrates into the voids in the compact 7.

The $Ta_2O_5$ and Cu powder used in Method 2 are the same as those used in the Method 1.

In Method 2, $Ta_2O_5$ powder may be the sole constituent of the compact, but if the percentage of voids in the compact is high (higher than about 65%), Cu powder may be used together with $Ta_2O_5$ powder and the apparent proportion of $Ta_2O_5$ in the compact may be decreased.

In this case, the proportion of Cu powder in the mixture should be no greater than 35% by volume, and preferably no greater than 20% by volume. The reason for the concurrent use of Cu powder is that if $Ta_2O_5$ is used alone, the compact collapses during handling when it contains 65% or more voids. If, for example, Cu and $Ta_2O_5$ each represent 50% by volume and there are 50% voids in the compact, it would be expected that the final composition will be 75% Cu by volume, and 25% $Ta_2O_5$ by volume. In practice, however, the compact is disintegrated in the molten Cu as will be described later, and a container is needed to hold it. If the proportion of Cu powder is also increased, the casting pressure tends to be greater.

In practice, the lower limit for the proportion of $Ta_2O_5$ in the final composition is 30% by volume, and it is found by experiment that the proportion of Cu powder should preferably be not less than 35% by volume.

The compact consists of $Ta_2O_5$ powder or a mixture of $Ta_2O_5$ powder and Cu powder, and it is formed by the usual methods in such a way that the percentage of voids in it is no greater than about 65%. If the percentage of voids is greater than 65%, the compact easily collapses and it is difficult to manufacture a contact material from it.

The compact obtained is then coated with, for example, Cu powder, placed in a crucible and heated in a nonoxidizing atmosphere such that the Cu powder melts. After that compact has been coated with molten Cu, the pressure of the gas atmosphere is raised to 100–2000 atm. and held for 30 min.–1 hours so that the molten Cu penetrates into the holes in the compact.

The heating temperature mentioned above should preferably be over the melting point of Cu so as to infiltrate the molten Cu into the voids in the compact.

The nonoxidizing atmosphere may be the same as used in Method 1, but in order to extract the interstitial gas in the contact material, it is preferable to maintain a vacuum when melting the Cu. It should be noted that if hydrogen is used at high temperature and pressure, it makes the pressure container brittle, and it is therefore preferable to use a mixture of argon and hydrogen, for example. Also, the pressure of the gas atmosphere during the pressurizing step should be not less than 100 atm., and it should preferably be not less than 100 times the pressure when the Cu has melted before pressurization in order to reduce the volume of interstitial gas in the contact material to 1/100 or less of its original volume.

After the Cu has infiltrated into the compact, it is cooled. When the Cu has solidified, the gas pressure is returned to normal pressure, and the contact material of this invention is thereby obtained.

Figure 3:
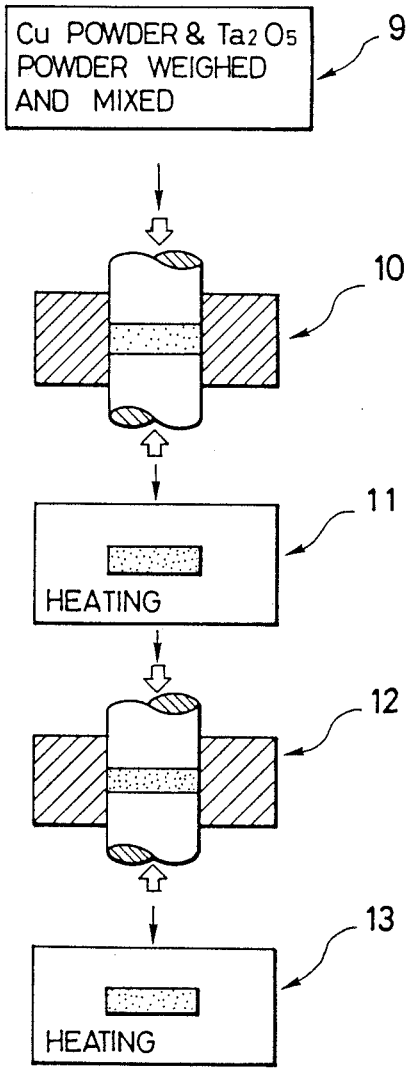
FIG. 3 is a flowchart showing the major steps in the manufacture of the contact material of Embodiment 3.

In Method 3, as shown in FIG. 3, Cu powder and $Ta_2O_5$ powder are first mixed together 9 and a green compact is manufactured the same as Method 1, 10. The compact obtained is then sintered in a nonoxidizing atmosphere below the melting point of Cu 11 and after re-pressing the sintered compact by hot working or cold working 12, it is resintered at 400°–900° C. in a nonoxidizing atmosphere 13.

The Cu powder and $Ta_2O_5$ powder used in Method 3 are the same as those used in Method 1 described above.

Cu/$Ta_2O_5$, the mixing proportion of Cu powder to $Ta_2O_5$ powder is 99/1–40/60 by volume, but taking electrical properties into consideration, it is preferable that this proportion is 60/40–55/45. If the percentage of $Ta_2O_5$ powder exceeds 60% by volume, the pressure used in the repressurizing step described below has to be very high, and in practice, the desired density cannot be achieved due to insufficient pressure.

The sintering of the compact manufactured from the powder mixture in the same way as in Method 1 is carried out below the melting point Cu, preferably at a temperature no higher than 1080° C. and no lower than 1050° C. If the sintering temperature is higher than the melting point of Cu and the Cu melts, it flows out of the compact since Cu and $Ta_2O_5$ have very poor mutual wettability. The sintering time should preferably be 3–5 hours in order that sintering can be carried out at normal pressure. Further, the nonoxidizing atmosphere used may be the same as in Method 1.

As the sintered compact obtained contains from 5 to 30% by volume of voids (the percentage of voids increases with an increasing proportion of $Ta_2O_5$), it is re-pressed to reduce these voids. There is no special restriction on the method used to carry out this re-pression, but it is preferable to carry it out at a temperature in the range of from ambient temperature to 400° C. At room temperature, the pressure may for example be 7000 Kg/cn$^2$ or higher, and should preferably be 3000 Kg/cm$^2$ or higher at 400° C.

The temperature during the resintering process may be 400°–900° C., and should preferably be in the region of 800° C. If resintering is carried out at a temperature above 900° C., the proportion of voids tends to increase again, and if it is carried out below 400° C., cracks tend to appear during subsequent mechanical processing to manufacture electrodes. The resintering time should preferably be 3–5 hours to eliminate stress and inprove cohesive strength of Cu. Resintering and re-pression can be repeated any number of times.

The contact material of this invention and its method of manufacture will now be described more concretely with reference to specific examples.

Embodiment 1

Cu powder (particle diameter no greater than 70 μm, purity not less than 99%), and $Ta_2O_5$ powder (particle diameter no greater than 40 m, purity not less than 99%), were weighed out in volumetric ratios of 99/1, 98/2, 95/5, 90/10, 85/15, 80/20, 70/30, 60/40, 50/50, 40/60, 30/70 and 20/80. After mixing in a ball mill, the mixture was packed into a carbon die, a temperature of 1050° C. maintained under vacuum, and the mixture pressed for 1 hour under a load of 200 kg/cm$^2$.

Figure 4:
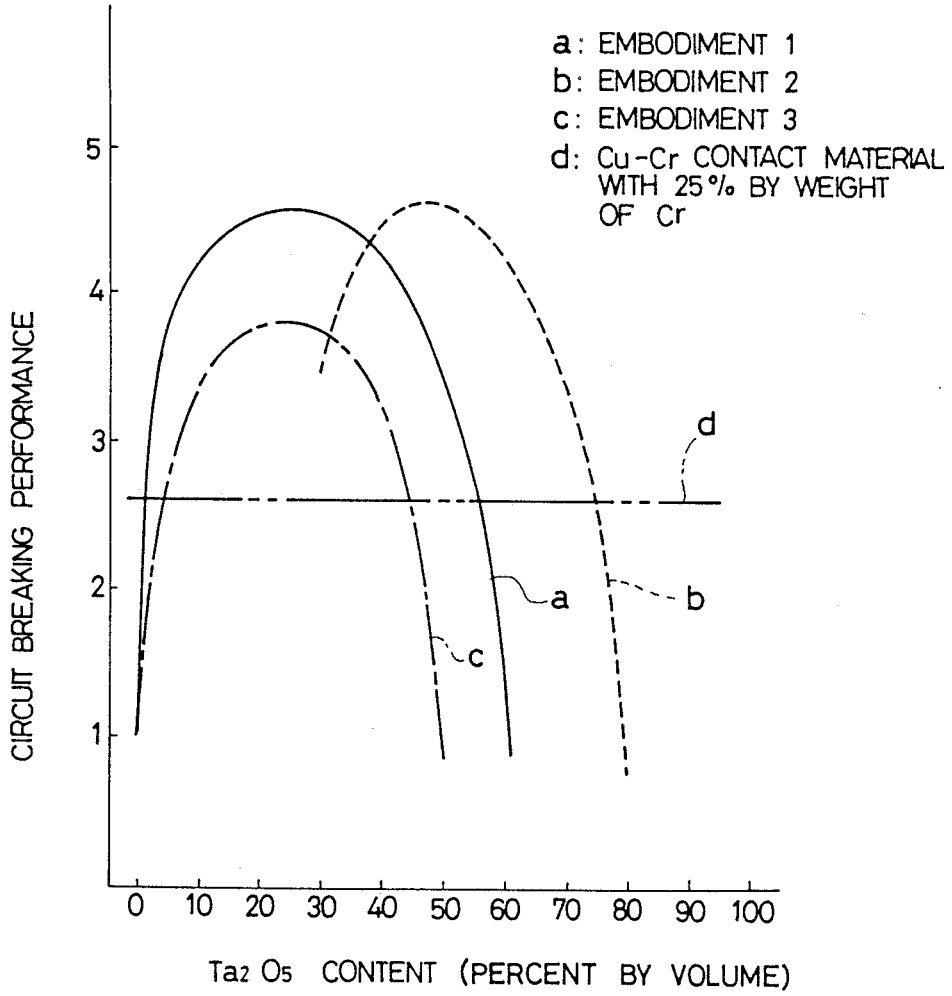
FIG. 4 is a graph showing the circuit breaking performance of the contact material in Embodiments 1-3.
Figure 5:
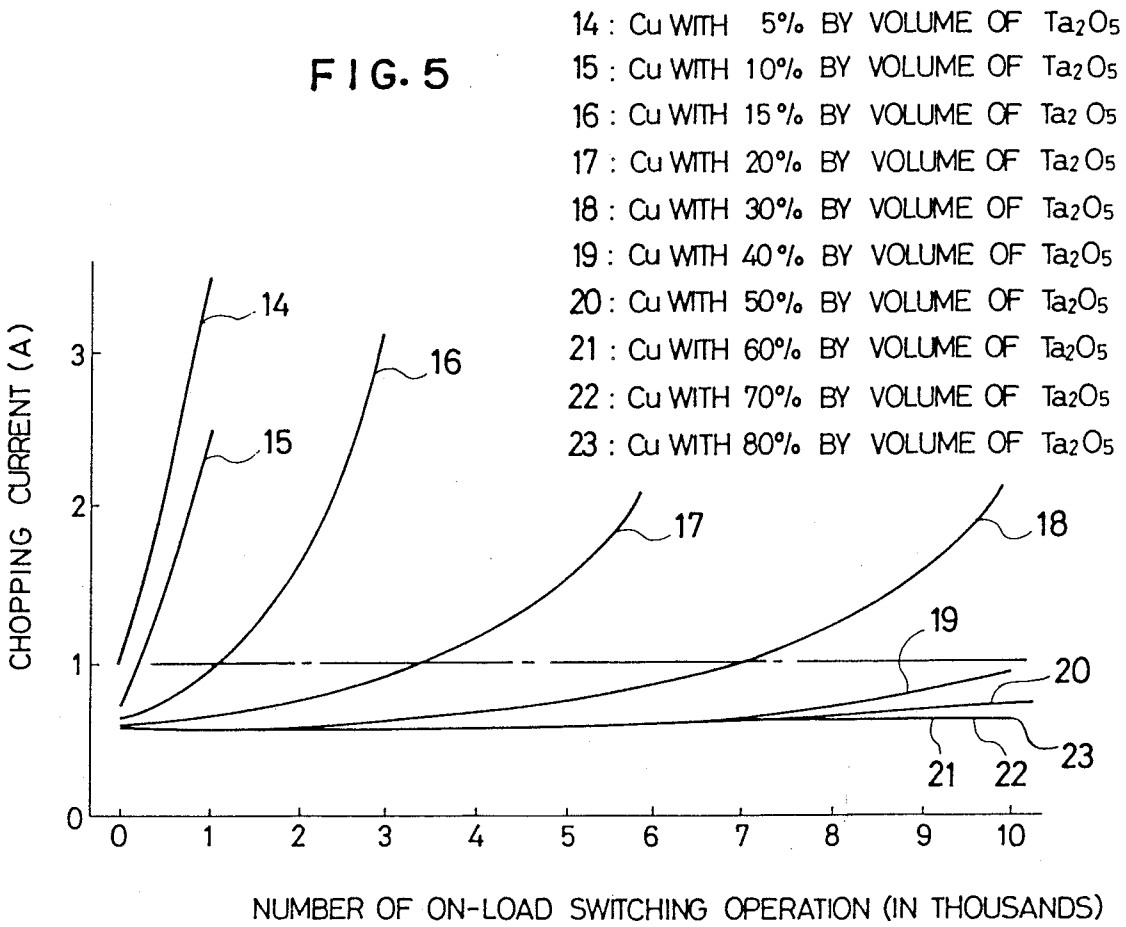
FIG. 5 is a graph showing the chopping currents of the contact materials in Embodiments 1-3.
Figure 6:
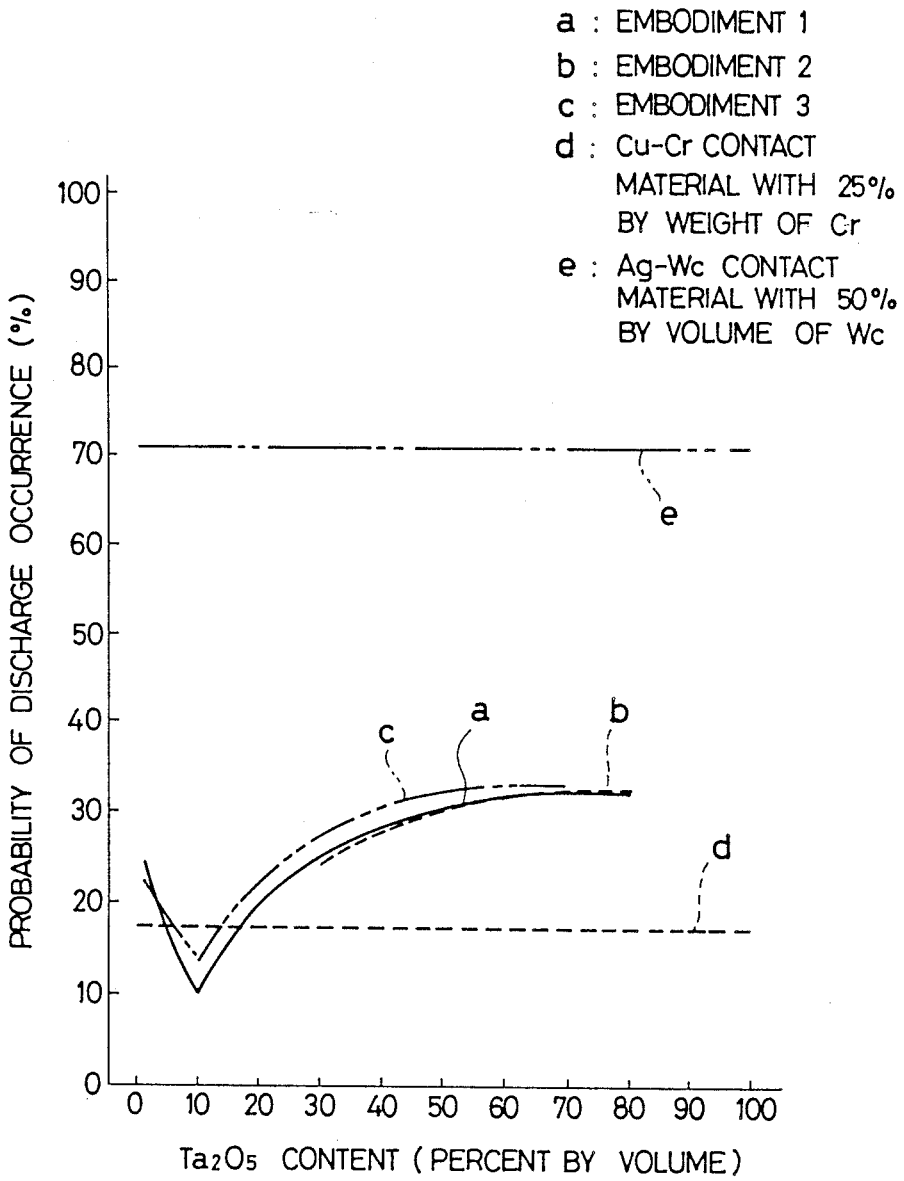
FIG. 6 is a graph showing the probability of discharge occurring in the contact materials of Embodiments 1-3.

The mixture was then cooled in this state to 800° C., and the pressing load was released. After cooling, the sintered compact was removed from the die, fashioned into desired electrode shapes by mechanical processing, and incorporated into vacuum switches. The circuit breaking performance, chopping current and withstanding voltage were then examined by the following methods. The results are shown in FIGS. 4–6.

(Circuit Breaking Performance)

In the circuit breaking test, the current was increased gradually from 5 kA. The final value of current at which circuit breaking occurred successfully was taken as the circuit breaking performance and compared to the performance of a contact material consisting only of Cu. In FIG. 4, d shows the performance of a Cu—Cr contact containing 25% by weight of Cr for comparison purposes.

(Chopping Current)

The chopping current was measured initially, and then after 1000, 3000, 6000 and 10,000 on-load switching operations with a load current of 600 A. Measurements were suspended any time the chopping current exceeded 1 A. The data in FIG. 5 are averages for contact materials in Embodiments 1–3 including $Ta_2O_5$ with the proportions shown in FIG. 5.

(Withstanding Voltage)

The contact was closed on a load of 1000 A, and opened on no load, and then a high voltage (30 kV) was applied with the contact open, and the presence or absence of discharge was checked. This cycle was repeated 1000 times, and the probability of discharge occurring was examined. In FIG. 6, d and e respectively show the performance of a Cu—Cr contact containing 25% by weight of Cr, and a WC—Ag contact with 50% by volume of Ag. Contacts with a low probability of discharge have an excellent withstanding voltage.

The wear of the contact was also examined when the chopping current was measured. It was found that for contacts containing not less than 30% by volume of $Ta_2O_5$, the wear was no greater than 0.1 mm even after 10000 on-load switching operations, i.e. the contacts suffered very little wear. For welding separation force, a current of 12.5 kA was passes for 3 sec, and the separation force measured by a tensile tester. It was found that the force was 30 kg f for a material containing 5% by volume of $Ta_2O_5$, but no greater than 10 kg f when the proportion of $Ta_2O_5$ was 10% by volume or more. In practice, weld was not observed for most of the contacts and it was evidence that the material causes very little weld.

Embodiment 2

The same mixtures of Cu powder and $Ta_2O_5$ powder were used as in Embodiment 1. In the case of contact materials wherein $Ta_2O_5$ accounted for not less than 50% of the final composition by volume, the powder was packed into a die such that the proportion of voids was respectively 55%, 45%, 32% and 30%. As described later, molten Cu infiltrates into these voids, but as some sintering of the $Ta_2O_5$ takes place in practice, the ratio Cu/$Ta_2O_5$ in the final composition becomes respectively 50/50, 40/60, 30/70 and 20/80. For materials wherein on the other hand $Ta_2O_5$ accounted for not more than 35% by volume of the final composition, a mixture of Cu powder and $Ta_2O_5$ powder was used so that the compact would not break during handling. A mixed powder where the ratio Cu/$Ta_2O_5$ was 35/65, was packed into a die such that the percentage of voids was respectively 61% and 53%. In these cases also, as some sintering of the $Ta_2O_5$ takes place as described above, the ratio Cu/$Ta_2O_5$ in the final composition becomes respectively 70/30 and 65/35. For materials wherein $Ta_2O_5$ in the final composition accounts for 35–50% by volume, Cu powder may or may not be used as desired. In the case described here, Cu powder was used. A mixed powder where the ratio Cu/$Ta_2O_5$ was 20/80 was packed into a die such that the percentage of voids was 56%. The ratio Cu/$Ta_2O_5$ in the final composition of this material was 60/40.

The compact obtained was so placed in a crucible that it was covered with Cu powder, and heated to 1200° C. in vacuum so as to cover it with molten Cu. Argon gas was then introduced, and its pressure raised to 100 atm. and maintained for 1 hour so that the molten Cu press-infiltrated into the voids of the compact. The compact was cooled to the solidification point of the molten Cu, and the ambient pressure was restored to atmospheric. After cooling, a piece containing Cu/-$Ta_2O_5$ was extracted by mechanically shaving from an infiltrated lump coated with Cu, an electrode was manufactured as in Embodiment 1, and the electrode incorporated into a vacuum switch. The circuit breaking performance, chopping current and withstanding voltage were then examined, and the results are shown in FIGS. 4–6. The wear and welding seperation force of the contact were also examined, and very similar results to those of Embodiment 1 were obtained.

Embodiment 3

As in Embodiment 1, Cu powder and $Ta_2O_5$ powder were weighed out in the proportions of 99/1, 98/2, 95/5, 90/10, 85/15, 80/20, 70/30, 60/40, 50/50, 40/60 and 30/70. After mixing in a ball mill, the mixture was packed into a die, and a compact was formed by applying a pressure of not less than 3000 Kg/cm$^2$. The compact obtained was sintered in an atmosphere of hydrogen at 1050° C. for 3 hours to give a sintered compact with 5–30% of voids by volume. The higher the $Ta_2O_5$ content, the higher the percentage of voids.

The sintered compact was then put into a metal mold, re-pressed at ambient temperature under a pressure of 7000 Kg/cm$^2$, and resintered in an atmosphere of hydrogen at 800° C. for three hours.

From the sintered compact, electrodes were manufactured as in Embodiment 1, and incorporated into vacuum switches. The circuit breaking performance, chopping current and withstand voltage were then examined, and the results are shown in FIGS. 4–6.

When the wear and welding separation force of the contacts were also examined, very similar results to Embodiment 1 were obtained.

The results obtained in Embodiments 1–3 which are shown in FIG. 4–6 will now be discussed.

From FIG. 4, the peak performance of Embodiment 1*a* was 4.5 times that of Cu, 1.7 times that of Cu with 25% Cr by weight; the peak performance of Embodiment 2*b* was 4.6 times that of Cu and 1.8 times that of Cu with 25% Cr by weight; the peak performance of Embodiment 3*c* was 3.8 times that of Cu and 1.5 times that of Cu with 25% Cr by weight. As the conventional Cu—Cr contact with 25% Cr by weight is fully adequate in practice from the viewpoint of circuit-breaking performance, it is preferable that the $Ta_2O_5$ content of the contact material of this invention is within a range where the material has superior circuit breaking performance to the conventional material, i.e. above line d in FIG. 4. Further, the difference in the peak heights of a and c in the FIGURE is due to the fact that whereas the density of the contact material in Embodiment 1 is not less than 99% of the theoretical ratio, the density of the material in Embodiment 3 is only about 96% of this ratio. Further, the difference in the positions of the peaks on a and b is due to difference in the structure of the contact material. In Embodiment 2, as described above, molten Cu is press-infiltrated into the voids of the compact, and so Cu is probably distributed more continuously compared to the case of materials manufactured by other methods even where the $Ta_2O_5$ content is high. Compacts manufactured by the method of Embodiment 2*b* with a high percentage of voids collapse very easily, and are difficult to manufacture. It is therefore preferable that the compact contains not less than 35% by volume of $Ta_2O_5$. But the compacts of $Ta_2O_5$ containing less voids were formed by sintering in air or oxygen to reduce the percentage of voids.

From FIG. 5, it is seen that for compacts containing 5% by volume of $Ta_2O_5$, the chopping current was approx. 1 A even the initial state (state when no on-load switching operations have been carried out), and that after 1000 on-load switching operations, it increased to as much as 35 A. As the proportion of $Ta_2O_5$ increased, however, the chopping current in the initial state declined, and at 40% or more by volume of $Ta_2O_5$, it fell to 0.55 A. As the $Ta_2O_5$ increased further, the increasing rate of the chopping current lowered even when the number of on-load switching operations increased; at 40% or more by volume of $Ta_2O_5$, the chopping current was not more than 1 A even after 10000 on-load switching operations, which is a really outstanding performance.

The chopping currents shown in FIG. 5 are average values. For materials containing a low proportion of $Ta_2O_5$ the maximum value of chopping current was also high, while for those with a high proportion of $Ta_2O_5$ the maximum value was low and stable. In the case of materials with 5% by volume of $Ta_2O_5$, for example, the maximum value of chopping current was 3 A even in the initial state, and it increased to 4 A after 1000 on-load switching operations. In the case of materials with 40% by volume of $Ta_2O_5$, on the other hand, the maximum value of chopping current was 0.7 A in the initial state, and it was not more than 1.2 A and was stable after 10000 on-load switching operations.

Unlike the case of circuit breaking performance, chopping current did not show much variation according to the manufacturing methods, showing that it had little dependence on this factor. The reason why the maximum value of chopping current depends on the $Ta_2O_5$ content but not on the manufacturing method as described above, is probably that the distribution of $Ta_2O_5$, the $Ta_2O_5$ content and the value of the current are relatively small. In other words, as the current used for on-load switching and the current used for the measurement of the arc are small, i.e., within a range of several 10 -several 100 A, the arc is small, and the point on the electrodes surface where the arc is generated is extremely small. If, therefore, $Ta_2O_5$ is present where the arc is generated, the chopping current will be low, but if it is generated on a Cu part, the chopping current will be large. For this reason, if the $Ta_2O_5$ content is high and it is uniformly distributed, the chopping current will be small. Further, although the surface layers of the electrode are gradually worn down by on-load switching operations, the chopping current will not increase sharply by on-load switching providing there is sufficient $Ta_2O_5$ in the contact. In the case of circuit breaking performance, on the other hand, as there is a heavy current arc as much as 12.5 kA. Consequently the entire surface of the contact is exposed to the arc, and the physical properties of the contact as a whole such as its electrical and thermal conductance become important. These properties often depend on the structure of the contact. In the case of contact materials manufactured in Embodiment 2 where molten Cu is made to penetrate into the compact, for example, Cu is continuously distributed throughout the structure. As a result, the electrical and thermal conductance are high, and the circuit breaking performance of the material is excellent even if it contains a large proportion of $Ta_2O_5$.

From FIG. 6, it is seen that when the contact material of this invention contains 5–17% by volume of $Ta_2O_5$, it is more difficult to cause a discharge than in the case of conventional Cu—Cr contacts with 25% Cr by weight, and it also has an excellent withstanding voltage. Further, it is seen that when the material contains 5–80% of $Ta_2O_5$, it is more difficult to cause a discharge than in the case of conventional Cu—Cr contacts with 25% Cr by weight, and it also has an excellent withstanding voltage. Further, it is seen that when the material contains 5–80% of $Ta_2O_5$, it is more difficult to cause a discharge than in the case of conventional Ag—WC contacts with 50% by volume of WC, and it has excellent performance. For contacts with 5% by volume of $Ta_2O_5$, some weld tends to occur albeit slight when the load is connected. This probably causes projection of Cu on the contact surface and hence easier discharge. In the case of contacts of pure Cu, considerable weld occurred when the load was connected, and measurements were not possible.

When the contact materials obtained in Embodiments 1–3 were analyzed by X-ray diffraction, to was found that apart from Cu and $Ta_2O_5$, they also contained compounds of the type of $TaO_2$ and $Ta_2O_3$.

From the above, it was thus established that the contact material of this invention has superior circuit breaking performance to conventional Cu—Cr contacts with 25% Cr by weight when the $Ta_2O_5$ content was within the range 2–75% by volume. The chopping current was no greater than 1 A when the $Ta_2O_5$ content was 40% or more by volume (the same level as that of conventional Ag—WC contacts with 50% by volume of WC). The withstanding voltage was high than that of conventional Cu—Cr contacts with 25% Cr by weight when the $Ta_2O_5$ content was 5–17% by volume, and higher than that of conventional Ag—WC contacts with 50% by volume of WC when it was 5–80% by volume. The contact material of this invention was also found to have excellent wear and welding separation force properties.

What is claimed is:

1. A vacuum switch contact material, consisting essentially of a mixture of $Ta_xO_y$ and Cu, wherein $x=1-2$, and $y=1-5$.

2. The contact material according to claim 1, wherein the proportion of Cu to $Ta_xO_y$ by volume is 60/40–25/75.

3. The contact material according to claim 1, wherein x and y in said formula is 2 and 5, respectively.

4. The contact material according to claim 1, wherein said Cu has a purity of not less than 99%, and a particle diameter no greater than 70 μm, while said $Ta_2O_5$ has a purity of not less than 99%, and a particle diameter no greater than 40 μm.

5. The contact material according to claim 1, wherein in said mixture of $Ta_xO_y$ and Cu, $Ta_xO_y$ particles are dispersed in Cu.

6. A vacuum switch contact material, consisting essentially of a sintered mixture of $Ta_xO_y$ and Cu, wherein $x=1-2$, and $y=1-5$.

7. A vacuum switch contact material, comprising a mixture of $Ta_xO_y$ and Cu, wherein $x=1-2$, and $y=1-5$.

* * * * *